US007207154B2

(12) United States Patent
Araujo

(10) Patent No.: US 7,207,154 B2
(45) Date of Patent: Apr. 24, 2007

(54) INTELLIGENT LUGGAGE PROTECTION POUCH, INTELLIGENT LUGGAGE PROTECTION POUCH KIT, AND METHOD OF PROTECTING LUGGAGE

(76) Inventor: Albert Araujo, 3350 SW. 139th Ave., Miramar, FL (US) 33027

( * ) Notice: Subject to any disclaimer, the term of this patent is extended or adjusted under 35 U.S.C. 154(b) by 0 days.

(21) Appl. No.: 11/174,399

(22) Filed: Jul. 1, 2005

(65) Prior Publication Data

US 2005/0278991 A1 Dec. 22, 2005

Related U.S. Application Data

(63) Continuation of application No. 10/616,431, filed on Jul. 9, 2003, now abandoned.

(51) Int. Cl.

| | |
|---|---|
| ***B65B 61/26*** | (2006.01) |
| ***B65B 61/14*** | (2006.01) |
| ***B65D 85/30*** | (2006.01) |
| ***B65D 33/06*** | (2006.01) |
| ***A45C 13/18*** | (2006.01) |

(52) U.S. Cl. ..... 53/410; 53/413; 53/416; 53/469; 53/480; 150/154; 190/26; 190/100; 206/459.5; 383/5; 383/41; 383/66; 383/86

(58) Field of Classification Search ..... 53/410–41, 53/415, 416, 469, 480, 481, 131.2, 135.1, 53/136.1, 136.5, 284.73; 40/6, 645, 649, 40/661; 383/5, 66, 41, 86, 210.1, 211; 206/459.5, 206/223, 232; 150/154, 105; 190/26, 100–102
See application file for complete search history.

(56) References Cited

U.S. PATENT DOCUMENTS

| | | | | |
|---|---|---|---|---|
| 3,901,360 | A * | 8/1975 | Cook | 190/26 |
| 4,653,113 | A * | 3/1987 | Taylor | 383/5 |
| 4,828,081 | A * | 5/1989 | Nordstrom et al. | 190/102 |
| 5,293,975 | A * | 3/1994 | Howorka | 190/26 |
| 5,531,059 | A * | 7/1996 | Dickinson | 53/413 |
| 5,547,051 | A * | 8/1996 | Bartscht et al. | 190/26 |
| 5,772,330 | A * | 6/1998 | Bang et al. | 383/87 |
| 5,947,604 | A * | 9/1999 | Bang et al. | 383/87 |
| 6,279,796 | B1 * | 8/2001 | Trevino | 224/153 |
| 6,637,563 | B1 * | 10/2003 | Ruckh | 190/108 |
| 6,982,643 | B2 * | 1/2006 | Garfinkle | 340/568.1 |
| 2003/0052786 | A1 * | 3/2003 | Dickinson | 340/572.8 |
| 2004/0206431 | A1 * | 10/2004 | Metzig et al. | 150/154 |

FOREIGN PATENT DOCUMENTS

| | | | |
|---|---|---|---|
| JP | 05068607 | A * | 3/1993 |
| WO | WO 9319993 | A1 * | 10/1993 |
| WO | WO 9719854 | A1 * | 6/1997 |

* cited by examiner

*Primary Examiner*—Stephen F. Gerrity
(74) *Attorney, Agent, or Firm*—Laurence A. Greenberg; Werner H. Stemer; Ralph E. Locher

(57) ABSTRACT

There is provided an intelligent luggage protection pouch according to the invention that is tamper resistant, easily identifiable, and inspection friendly (i.e. x-ray and canine searchable). The intelligent luggage protection pouch fully surrounds luggage, protects against damage to the surface of the luggage, withstands the weight of any luggage placed within it, and prevents loss of the contents of the luggage. The intelligent luggage protection pouch does not require specialized machines, tools, or knowledge. Preferably, the intelligent luggage protection pouch is disposable, environmentally friendly, and universally sized to accommodate luggage of almost any size and shape. The intelligent luggage protection pouch may be included in a kit.

18 Claims, 8 Drawing Sheets

INTELLIGENT LUGGAGE PROTECTION POUCH, INTELLIGENT LUGGAGE PROTECTION POUCH KIT, AND METHOD OF PROTECTING LUGGAGE

CROSS-REFERENCE TO RELATED APPLICATION

This is a continuation of U.S. application Ser. No. 10/616,431, filed Jul. 9, 2003, now abandoned, which is hereby incorporated herein in its entirety.

BACKGROUND OF THE INVENTION

1. Field of the Invention

This invention relates to pouches and bags for luggage protection that provide tamper evidence. This invention relates to pouches and bags having intelligent means for labeling and tracking luggage. More specifically, this invention relates to intelligent luggage protection pouches and bags having means for labeling, tracking the luggage enclosed therein.

2. Description of the Prior Art

On average, 10 billion dollars are spent in the United States on travel and travel-related goods and services. Estimated annual passengers during 2005 are 637 million in the U.S. and 1.2 billion in the world. The average passenger checks 1.7 pieces of luggage. Thus, in 2005, there will be over 2 billion pieces of luggage checked throughout the world.

Despite efforts by the airline industry, passengers continue to report incidents of luggage being mishandled by airport and/or airline personnel. For example, the U.S. Department of Transportation reported that American Airlines, the largest air-carrier in the United States, enplaned 6,595,558 passengers during August 2001 and received 30,006 complaints regarding mishandled luggage during that month, which is a rate of about 4.5 complaints per 1000 passengers. In August 2002, American Airlines enplaned 7,579,938 passengers and received 28,744 baggage related complaints, which is a rate of about 3.8 complaints per 1000 passengers.

Passengers place a high value on safeguarding the contents held within their luggage. Passengers are also desirous of protecting the structure and finish of their luggage. Passengers concerns about their luggage and the contents held therein, while present whenever and wherever passengers travel, are particularly common for passengers traveling by air. The bags of airline passengers are transferred and handled by a large number of unseen airport and airline personnel, making it likely that at least some bags will be damaged, stolen, or pilfering during their transit. It is also difficult for the owners of mishandled bags to determine when and where their bag was damaged, stolen, or pilfered.

Prior art locking devices are not effective for safeguarding the contents of a checked bag. While locks on luggage may be provided as a deterrent to theft and pilfering, they can be easily be broken and removed with little or no evidence drawing attention to the compromised condition of the luggage. When the passenger sees the damage, many hours and many hundreds of miles may separate the passenger from the time and location of the damage.

As the number of airline passengers increases both domestically and worldwide, there is an increasing volume of luggage that must be processed by the airports and airlines. However, the infrastructure for processing luggage at airports continues to be a weak point. For example, barcode tags on luggage are used for sorting bags, but there is no system for using the barcode tags to continuously track bags. Moreover, even for the routine task of sorting bags, the barcode tags are capable of a read-through rate of only about 70% to about 80%, meaning that baggage personnel must be heavily relied upon to make sure that the hundreds of bags passing by them every day are properly sorted. Unfortunately, these baggage personnel, who must be relied upon, may roughly handle or ransack the luggage that they are supposed to safeguard, especially since they usually work for low pay without competent supervision.

For security reasons, radio frequency identification (RFID) technology is being introduced to increase the speed and accuracy of matching passengers with their luggage, which is referred to as positive passenger bag matching. However, positive passenger bag matching is concerned with security at the point of departure only. At the point of arrival, positive passenger bag matching cannot ensure that bags are not illicitly opened, or locate lost bags.

SUMMARY OF THE INVENTION

In light of the foregoing background, the basic purpose of the present invention is to provide the traveler with an affordable, convenient, and tamper-resistant luggage protection pouch complimented by intelligent means for providing identification and/or location.

An intelligent luggage protection pouch according to the present invention is tamper resistant, easily identifiable, and inspection friendly (i.e., x-ray and canine searchable). The intelligent luggage protection pouch fully surrounds luggage, protects against damage to the surface of the luggage, withstands the weight of any luggage placed within it, and prevents loss of the contents of the luggage. The intelligent luggage protection pouch does not require specialized machines, tools, or knowledge. Preferably, intelligent luggage protection pouch is disposable, environmentally friendly, and universally sized to accommodate luggage of almost any size and shape. The intelligent luggage protection pouch may be included in a kit.

DESCRIPTION OF THE INVENTION

As used herein, the terms "baggage," "bag," and "luggage" are synonymous and refer to any container that may be used for holding goods, equipment, and belongings being transported. Types of luggage include, but are not limited to, large or "Pullman" suitcases, standard suitcases, garment bags, duffle bags, tote bags, and brief cases. The current invention may also be useful in protecting and securing cargo crates and/or cartons of commercial goods.

Figure 1:
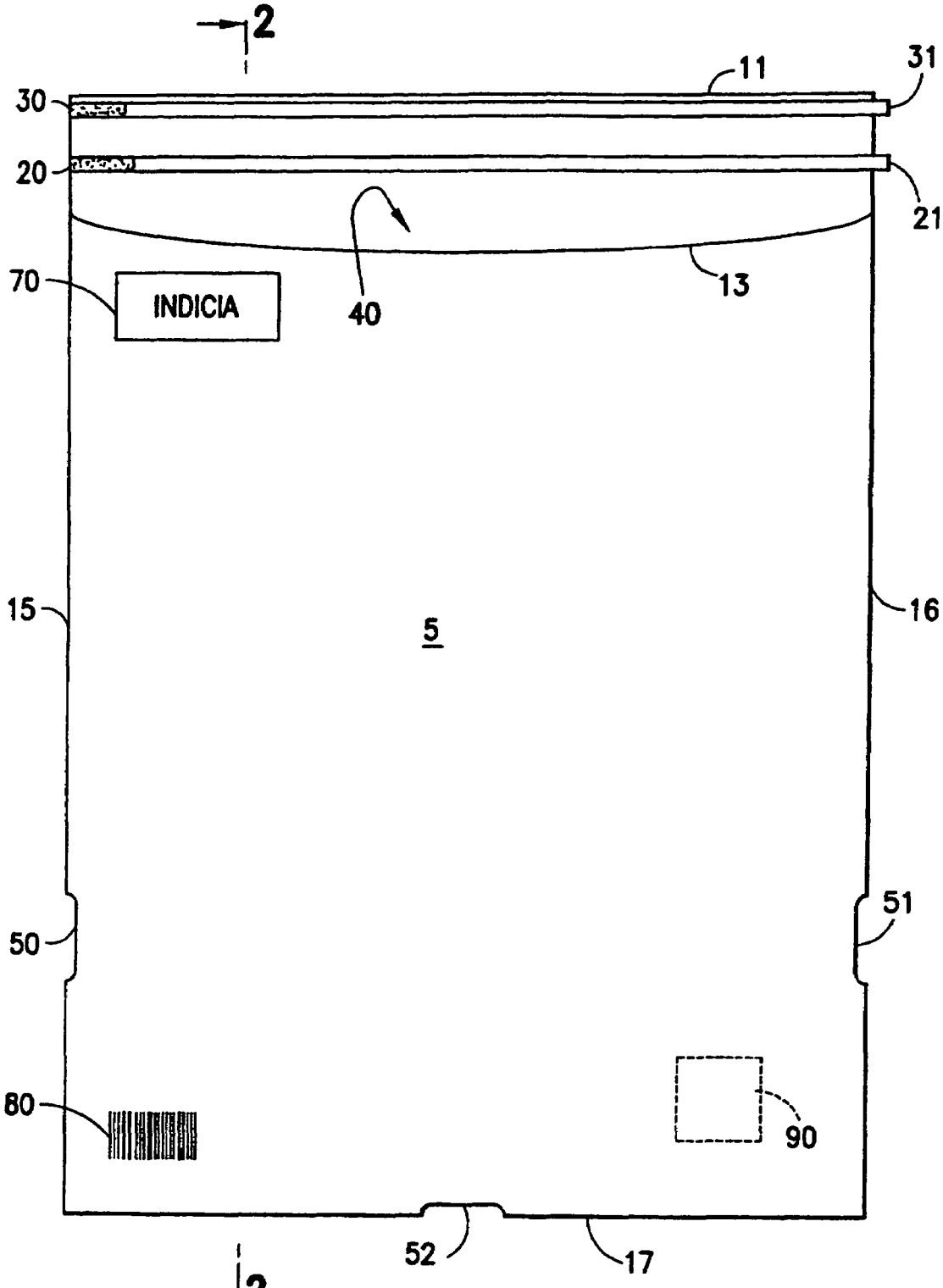
FIG. 1 is a front view of an intelligent luggage protection pouch according to the present invention.

Referring to the drawings and, in particular, FIG. 1, there is shown an intelligent luggage protection pouch according to the present invention, generally indicated as reference numeral 1.

Figure 2:
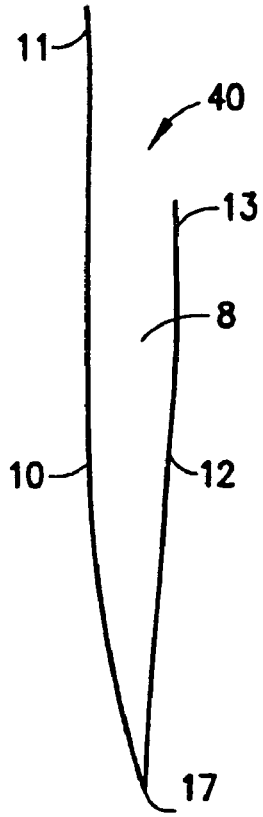
FIG. 2 is a cross-section view of the intelligent luggage protection pouch of FIG. 1.
Figure 4:
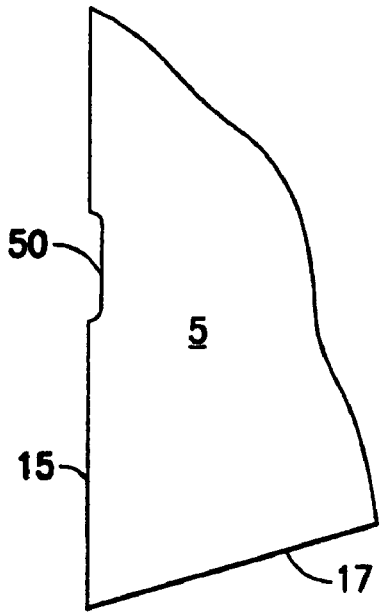
FIG. 4 is a detail perspective view of a luggage-handle opening in the intelligent luggage protection pouch of FIG. 1.

As shown in FIGS. 1 and 2, pouch 1 comprises a flexible, contiguous pouch body 5 having a contained interior space 8 adapted to hold a piece of luggage (not shown). Pouch body 5 is preferably substantially continuous and uninterrupted to prevent inadvertent loss of the contents from the interior space 8. As illustrated in FIGS. 1 and 2, pouch body 5 comprises first and second panels 10, 12. Panel 10 has a larger surface area compared to panel 12. Panels 10, 12 may be separately formed as individual panels and sealed along side edges 15, 16, and bottom edge 17. Alternatively, panels 10, 12 may be co-formed as a single sheet that is subsequently folded to create bottom edge 17 and sealed along side edges 15, 16. Flap 14 is a portion of panel 10 that is not overlapped by panel 12. An openable mouth 40 is defined between top edge 11 of panel 10 and top edge 13 of panel 12. Openable mouth 40 communicates with the contained interior space 8 (see FIG. 2). As shown, pouch 1 comprises panels 10, 12, which are substantially square-shaped. However, pouch 1 may have any shape and construction suitable for securely surrounding luggage. For example, pouch body 5 may be a seamless film or constructed from three or more panels, for example, when pouch 1 has a double-walled construction or an expandable gusset. Pouch can optionally be provided with a pocket (not shown) for receiving documentation or other materials for identification, informational, or other purposes. The pocket would preferably be formed between panels 10, 12. The pocket could be integrally formed with one of the panels 10,12, or formed separately and attached to one of the panels 10,12 by an adhesive, thermal or solvent welding, or other attachment means.

Pouch body 5 is made of a material that is resistant to tears, punctures, abrasions, and inclement temperatures. In light of its intended use to securely surrounding luggage, pouch body 5 is preferably made of a material with a burst strength of at least about 100 lbs. (45 kg). For securing and protecting luggage, it has been found that overall tear resistance is more advantageous than puncture resistance. Preferred materials for a bag according to the present invention include polymeric materials. The material may be may be a thermoplastic polymer or copolymer comprised of polyethylene-based polymers, polystyrene, polypropylene, nylon, polycarbonate, or other similar materials. Useful polyethylene-based polymers include low-density polyethylene, linear low-density polyethylene, metallocene, ethylene vinyl acetate, or other similar materials. A preferred material for wall 5 is co-extruded 3-ply polyethylene having a thickness of about 3 mil. The thickness of wall 5 may be about 1 mil to about 6 mil depending upon whether pouch 1 will be subject to light duty or heavy duty. Reinforcing materials such as Kevlar.RTM. and/or nylon fibers may be used in wall 5. Wall 5 may comprise heat-shrink plastic (i.e., low-density polyethylene).

There are several methods that may be employed to form pouch body 5. One approach is to form pouch body 5 in a single extrusion operation. A second approach uses adhesive, such as glue or tape, to form seams 15, 16, and 17 of pouch body 5. For example, panels 10, 12 may be joined by a liquid adhesive. After the liquid adhesive is applied, panels 10, 12 are pressed together until the liquid adhesive dries and/or cools to form seams 15, 16, and 17. A third approach involves the use of sonic and/or heat welding. For example, panel 10 may be fed from a first stock and panel 12 may be fed from a separate, second stock. In a sealing station, heating bars join panels 10, 12 along seams 15,16, and 17.

Pouch 1 may be made in multiple layers through coextrusion. In these multiple layered bags, there are at least three layers and can be more layers depending upon the functions desired. The coextrusion provides the advantageous feature of a dual slip property. For example, the layer intimate with the containment region of the bag, i.e., the layer that comes in contact with the luggage, may have a low coefficient of friction. This allows luggage to be easily loaded into the bag. On the other hand, the layer on the outside of the bag, that is, the layer which will come into contact with the baggage handlers, may be constructed with a high coefficient of friction to provide a tacky surface conducive to gripping and handling. In these arrangements, there is at least a middle layer that may be formed from a recycled or a virgin polyethylene material. The material for pouch 1 is also most preferably made from a combination of recycled and virgin materials, and is recyclable itself.

Pouch 1 has a shape and size adapted for surrounding the largest standard piece of luggage that is likely to be used by travelers. For example, in general, the dimensions (length+width+height) of an average piece of checked luggage add up to about 62 inches (157 cm). An average piece of checked luggage weighs about 70 lbs. (32 kg). The exterior dimensions (length+width+height) of an average piece of carry-on luggage add up to about 45 inches. An average piece of carry-on luggage weighs about 40 lbs. (18 kg). Pouch 1 is preferably of a shape and size to easily accommodate either of the foregoing average pieces of checked and carry-on luggage. More preferably, without including flap 14, the dimensions of pouch 1 are about 40 inches by about 48 inches (about 100 cm by about 122 cm). Flap 14 is preferably about 5.5 inches (about 14 cm).

In order to securely surround a piece of luggage, the mouth 40 of pouch 1 must be closeable. The closure preferably forms a substantially hermetic seal preventing inadvertent loss of any contents from contained interior space 8. Accordingly, the present invention provides that pouch 1 may comprise both a temporary sealing element and a permanent sealing element. Pouch 1 preferably comprises one or more sealing elements disposed adjacent to mouth 40 and adapted to close mouth 40. Preferably, the one or more sealing elements are disposed on flap 14 such that, when mouth 40 is closed, the volume of the contained interior space 8 within pouch body 5 is substantially undiminished.

Figure 3A:
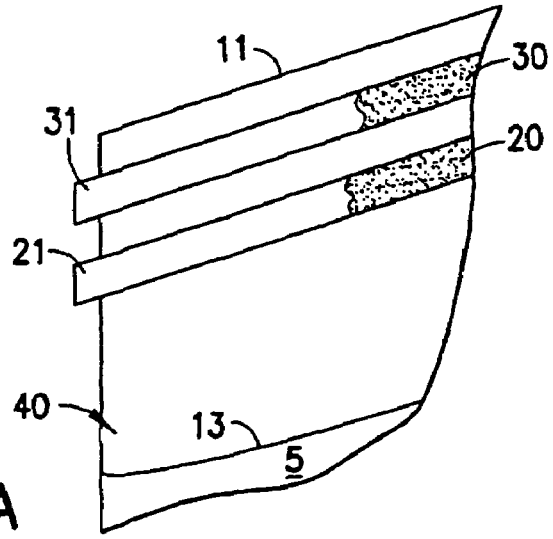
FIG. 3A is a detail perspective view of a tamper-resistant seal and a temporary seal for the main opening of the intelligent luggage protection pouch of FIG. 1.

Referring to FIG. 3A, pouch 1 preferably comprises sealing elements 20 and 30 on flap 14. Sealing elements 20, 30 are either temporary or permanent sealing elements. If sealing element 30 is a temporary sealing element and sealing element 20 is a permanent sealing element, pouch 1 may be opened and closed as many times as needed using temporary sealing element 30 before permanent sealing element 20 is engaged to panel 12. If both sealing elements 20, 30 are permanent sealing elements, after closing pouch 1 with sealing element 30, pouch 1 may be unsealed by cutting or tearing flap 14 between sealing elements 20, 30. To facilitate cutting or tearing of flap 14, the area thereof between sealing elements 20, 30 may, for example, be relatively thinner or provided with a line of perforations. The sealing elements may be made from a variety of adhesive and non-adhesive materials, so long as it provides the function of enabling secure closure of mouth 40. One preferred adhesive includes a double-coated clear polypropylene film tape having a 100% plastic film release liner. Different colors may be employed to identify different sealing elements. For example, sealing element 30 may be green if adapted as a temporary sealing element, and sealing element 20 may be red if adapted as a permanent sealing element.

Sealing element 30 is a strip about 0.75" tall and extending completely along panel 10 between edges 15, 16, and is disposed about 0.25" from top edge 11. Preferably, sealing element 30 is removeably covered by a non-adhesive, protective strip 31. Sealing element 20 is a strip about 0.75" tall extending completely along panel 10 between edges 15,16, and is disposed about 3" from top edge 11. Preferably, sealing element 20 is removeably covered by a non-adhesive, protective strip 21. The sealing elements may have any size, shape, and arrangement suitable for closing mouth 40 without unduly reducing the volume of the contained interior space 8 defined by pouch body 5.

Figure 3B:
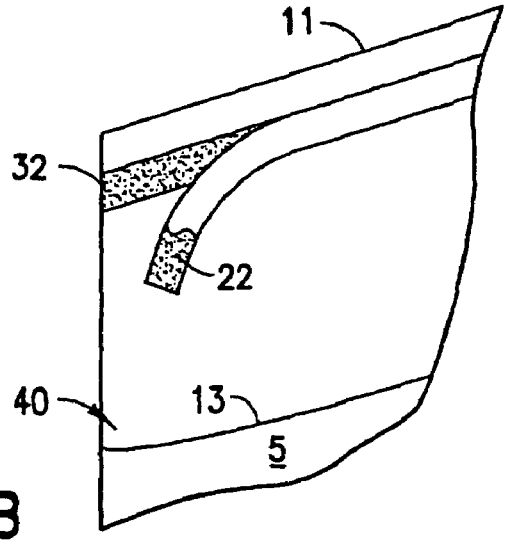
FIG. 3B is a detail perspective view of an alternative arrangement of a tamper-resistant seal and an overlapping temporary seal for the main opening of the intelligent luggage protection pouch of FIG. 1.

Referring to FIG. 3B, the two sealing elements may be overlapped if a sealing element strip 22 removeably covers a sealing element strip 32. For example, sealing element strip 22 may be single-sided, low-adhesive tape with a backing material, such as high-density polyethylene, adapted to removeably adhere and completely cover a sealing element strip 32. Sealing element strip 22 may be removed when the sealing element strip 32 will be used to permanently, securely seal mouth 40.

Figure 3C:
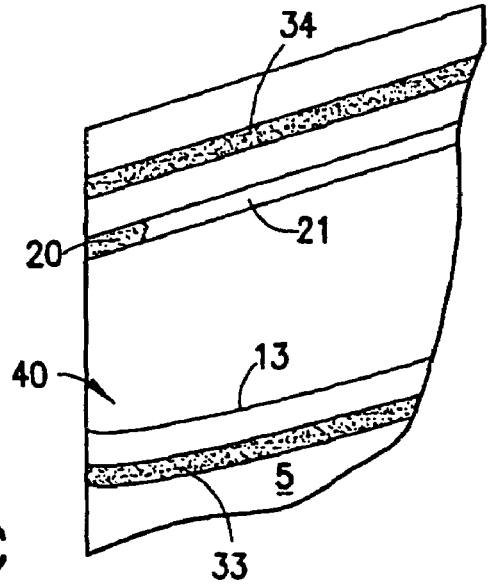
FIG. 3C is a detail perspective view of an alternative arrangement of a tamper-resistant seal for the main opening of the intelligent luggage protection pouch of FIG. 1

Referring to FIG. 3C, the present invention contemplates an embodiment wherein the temporary sealable section comprises a reclosable mechanical closure such as, for example, a flexible tongue-and-groove closure (e.g., a Ziploc.RTM. closure). A first mechanical closure element 33 is provided on flap 14, and a second mechanical closure element 34 adapted to releasably engage first mechanical closure element 33 is provided on panel 12 adjacent to edge 13. For example, first closure element 33 may be a tongue-shaped element, and second closure 34 element may be a groove adapted to releasably engage the tongue-shaped first closure element 33. First and second closure elements 33, 34 may be integrally formed with panels 10, 12, or may be separately formed and attached by adhesive, welding, or other attachment means.

Referring again to FIG. 3A, in a preferred form, sealing elements 20, 30 are both permanent or tamper-resistant sealing elements. Tamper-resistant sealing elements 20,30 are disposed on or within flap 14, whereby the permanent sealing section can engage the outer surface of panel 12 when flap 14 is folded over to cover mouth 40, thereby preventing access to contained interior space 8. Permanent sealing elements 20, 30 may comprise, for example, a pressure-sensitive adhesive such as double-sided tape, and are preferably covered with removable protective strips 21, 31. Flap 14 is foldable between an open configuration, and a closed configuration. The preferred adhesive of permanent sealing elements 20, 30 adheres strongly to a contact portion of panel 12, whereby attempts to detach permanent sealing sections 20, 30 or otherwise tamper with permanent sealing sections 20, 30 result in plainly observable damage or alteration of pouch body 5, indicating potential damage or tampering. The contact portion for permanent sealing section 20 is preferably the outer surface of panel 12. Alternatively, permanent sealing section 20 may be provided on the outer surface panel 12 and the contact portion is the surface of flap 14.

There are several potential methods of attaching the sealing sections described above to pouch body 5. A first method is to form pouch body 5 and one or more sealing sections in a single extrusion operation. For example, referring to FIG. 3A, the seals 20, 30 may be joined to pouch body 1 by a liquid adhesive. After the adhesive is applied, pouch body 5 and sealing sections 20, 30 are pressed together by a presser roll and a backing roll. A third approach involves the use of sonic and/or heat welding. For example, pouch body 5 may be fed from a first stock and closure elements 20, 30 are fed from respective second and third stocks. In a sealing station, the closure elements and pouch body 5 are welded together by a pair of heating bars. A fourth approach involves joining pouch body 5 to a relatively freshly extruded closure element. For example, pouch body 5 may be from a first stock and transferred to an extrusion station having a heated stock from which the closure element is transferred to pouch body 5. If pouch 1 comprises a reclosable mechanical closure as shown in FIG. 3C with two or more releasably engagable components, such as mechanical closure elements 33, 34, one or more of the releasably engagable components may be formed with pouch body 5 during a single extrusion operation. An alternative approach uses adhesive, such as glue or tape, to join the releasably engaging components to pouch body 5.

Referring again to FIG. 1, the present invention contemplates the provision of at least one handle-receiving aperture 50, 51, or 52, which are openings in pouch body 5 for the protrusion of the luggage handles. For the embodiment illustrated by FIG. 1, handle-receiving apertures 50, 51, and 52 take the form of discontinuities in respective edges 15,16, and 17, which discontinuities are roughly the size of the handle of an average piece of luggage. For easier access to the handle of luggage within pouch 1, handle-receiving apertures 50, 51, and 52 may be in the form of semi-oval notches. Handle-receiving apertures 50, 51, and 52 may alternatively be rectangular, transverse openings, or simply slits in respective edges 15,16, and 17. Handle-receiving apertures 50, 51, and 52 may have elastic collars that engage tightly around the base of the handle in a substantially watertight arrangement. In another alternative embodiment, pouch body 5 may have one or more brief lines of perforations adapted, when broken, to form handle-receiving apertures 50, 51, and 52.

Pouch 1 preferably comprises words and/or symbols, generally indicated as reference numeral 70, for the user to easily and quickly identify his or her luggage. The words may be provided in multiple languages, and the symbols may be universally recognized signs. Pouch 1 may comprise instructions, directions, and warnings. Graphic designs and advertisements may be applied or imprinted on pouch 1. In certain embodiments, pouch 1 comprises indicia, such as, for example, a printed or embossed design, which facilitates easier observation of tampering by attempted or actual detachment of sealing elements 20, 30. For example, detachment of permanent sealing element 20 from a printed design provided on the contact portion will result in removal of at least a portion of the ink or other material forming the design from the contact portion. The provision of indicia comprising an intricate, regular pattern, such as for example a bulls-eye pattern or cross-hatching, will more readily indicate tampering. In certain embodiments of the present invention, pouch 1 includes indicia expressly showing where the bag is to be picked up and handled. This may include, for example, a colored mark such as arrows, rectangles, or other indicia at the ends of the bag to show where the bag may most easily be grasped. Other indicia may include arrows or other marks highlighting the perforation strip so that the passenger, when claiming his luggage, can easily identify where it is he is to rip the bag in order to access his luggage. The indicia may be designed with a variety of colors and patterns that, in combination with the structure of the bag, may provide a particularly ornamental or attractive appearance.

Significantly, pouch 1 comprises means for unique identification including, but not limited to, at least one barcode (reference numeral 80), personal identification number (PIN) and/or serial number (e.g., an International Air Transport Association number), smart card, transmitter/transponder (reference numeral 90), such as an RFID card or Global Positioning System transmitter/transponder, special design shape, or any combination thereof. When used, the transmitter/transponder 90 would preferably be incorporated into pouch 1 or permanently affixed to pouch 1. More preferably, pouch 1 comprises an RFID card 90 and at least one barcode 80. RFID cards may be tracked or read without the need for line-of-sight between the RFID card and the tracking device or reader. Moreover, RFID cards may be continuously tracked when adapted as active transponders or active transmitters. RFID cards enjoy approximately 99% read-through, which virtually eliminates the need to "re-scan" the RFID card. Regarding barcodes, current technology for tracking and reading barcodes is very widespread and relatively inexpensive. While read-through for barcodes is only about 70%, barcodes do not require a potentially short-lived or expensive power-source. More importantly, the combination of an RFID card and at least one barcode provides means for identity authentication. An authentic identification would require matching both the correct barcode and the correct RFID, whereby the "right" RFID and the "wrong" barcode would clearly indicate tamper (i.e., that the initial pouch with the "right" barcode had been destroyed).

Figure 5:
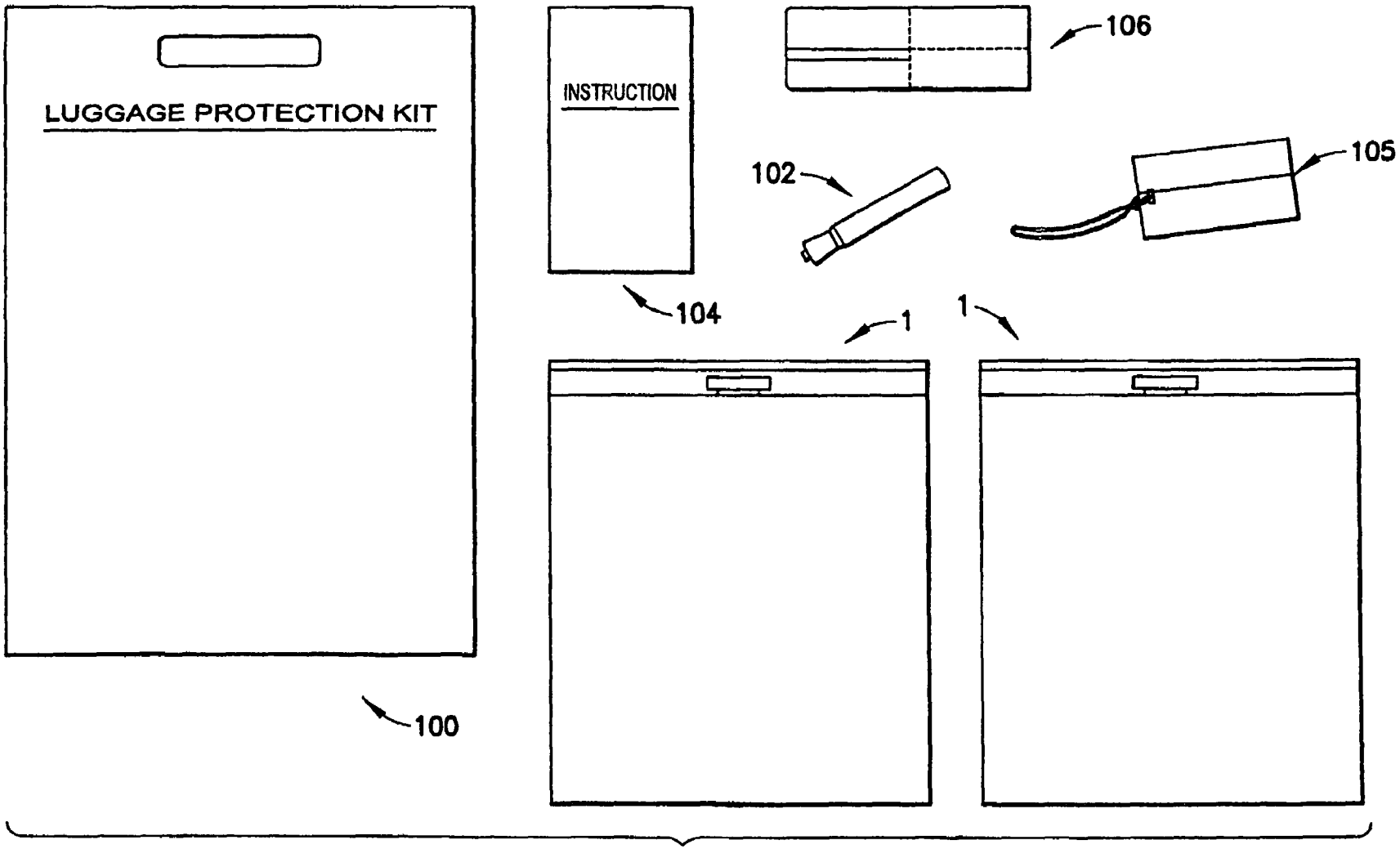
FIG. 5 shows the contents of a luggage protection kit including the intelligent luggage protection pouch of FIG. 1.

Referring to FIG. 5, the present invention provides that pouch 1 may be included in a luggage protection kit. A luggage protection kit according to the present invention will include at least one of the afore-described luggage protection pouches 1, along with other items adapted to be used in combination with a luggage protection pouch according to the present invention. Referring to FIG. 5, a preferred luggage protection kit according to the present invention includes a luggage protection kit container bag 100, two luggage protection pouches 1, a writing implement 102 (i.e., a felt-tipped marker), a cutter/opener (not shown), an instruction manual 104, and an RFID card tag 105. The RFID card tag 105 will preferably be adapted for external attachment to a piece of luggage that will be disposed within luggage protection pouch 1. As shown in FIG. 5, RFID card tag 105 comprises a flexible loop that is useful for hitching the RFID card tag to the handle on a piece of luggage, although any suitable means may be used for attaching the RIFD card tag to a piece of luggage, including, for example, an adhesive or magnetic strip. In addition, the luggage protection kit may include goods and/or products, generally indicated as reference numeral 106, that are related to the travel industry and intended to advertise and/or inform a traveler who purchases the luggage protection kit about travel insurance, calling cards, discount coupons, product samples, magazines, entertainment media, etc.

In a preferred method of use, contents are deposited in the interior region 8 of pouch 1. Pouch 1 may be sealed by removing protective strip 31 and folding flap 14 over mouth 40 to engage sealing element 30 with panel 12. If sealing element 30 is a temporary sealing element, additional contents can be deposited, or deposited contents can be removed from the interior region by selectively opening and resealing the temporary sealing element 30. If sealing element 30 is a permanent sealing element, additional contents can be deposited, or deposited contents can be removed from interior space 8 by cutting flap 14. Upon completion of the loading and/or inspection of the contents of pouch 1, protective covering 21 over permanent closure element 20 is removed and flap 14 is folded over mouth 40 such that permanent closure element 20 contacts the surface of panel 12. Subsequent attempts to access the contents or open permanent closure element 20 will evidence tampering. When it is desired to open the bag to access the contents, a portion of the bag is detached, for example, by tearing pouch 1 with a cutter/opener 103 (see FIG. 6).

Figure 6A:
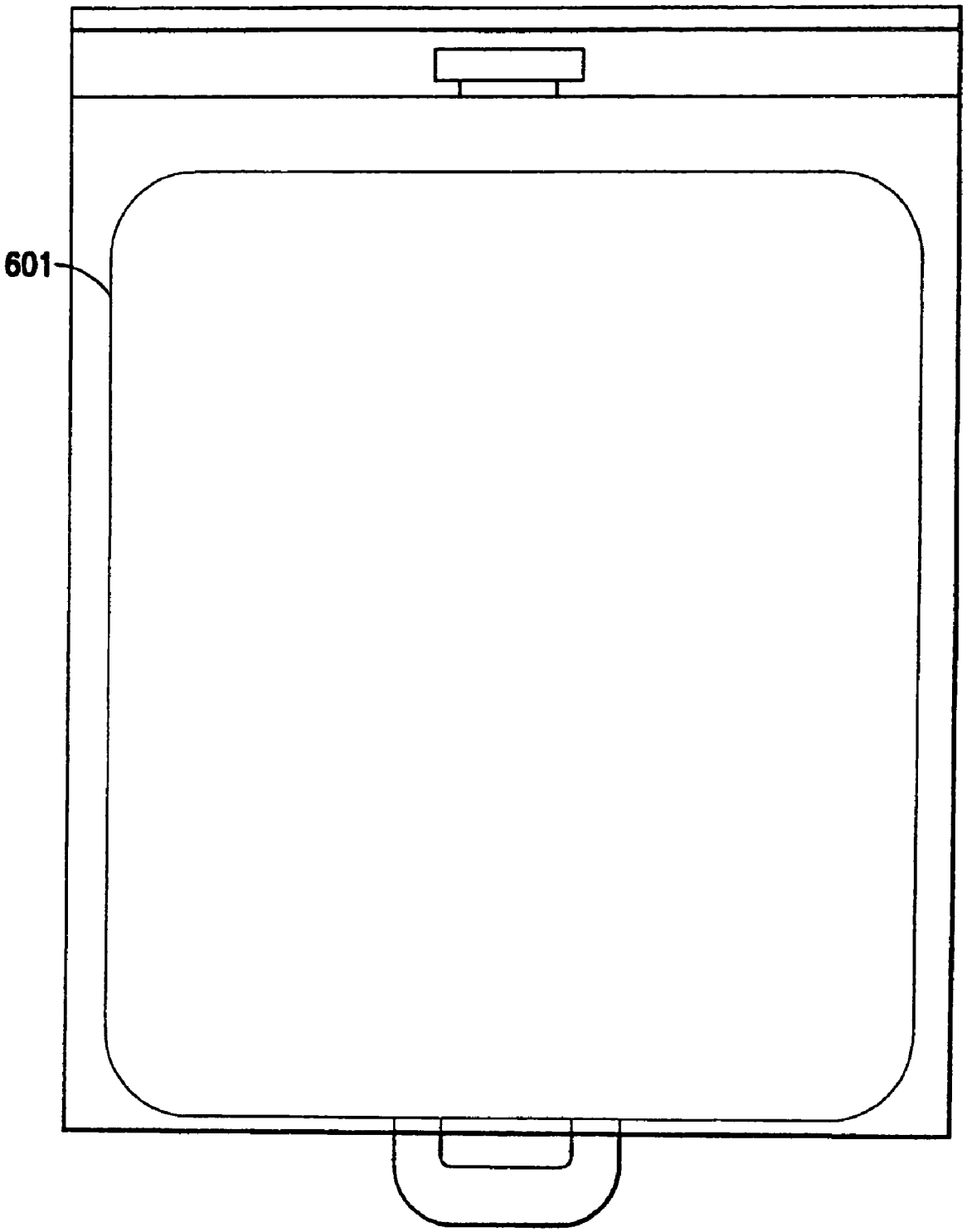
FIG. 6A is a plan view of a large suitcase surrounded by the intelligent luggage protection pouch of FIG. 1.
Figure 6B:
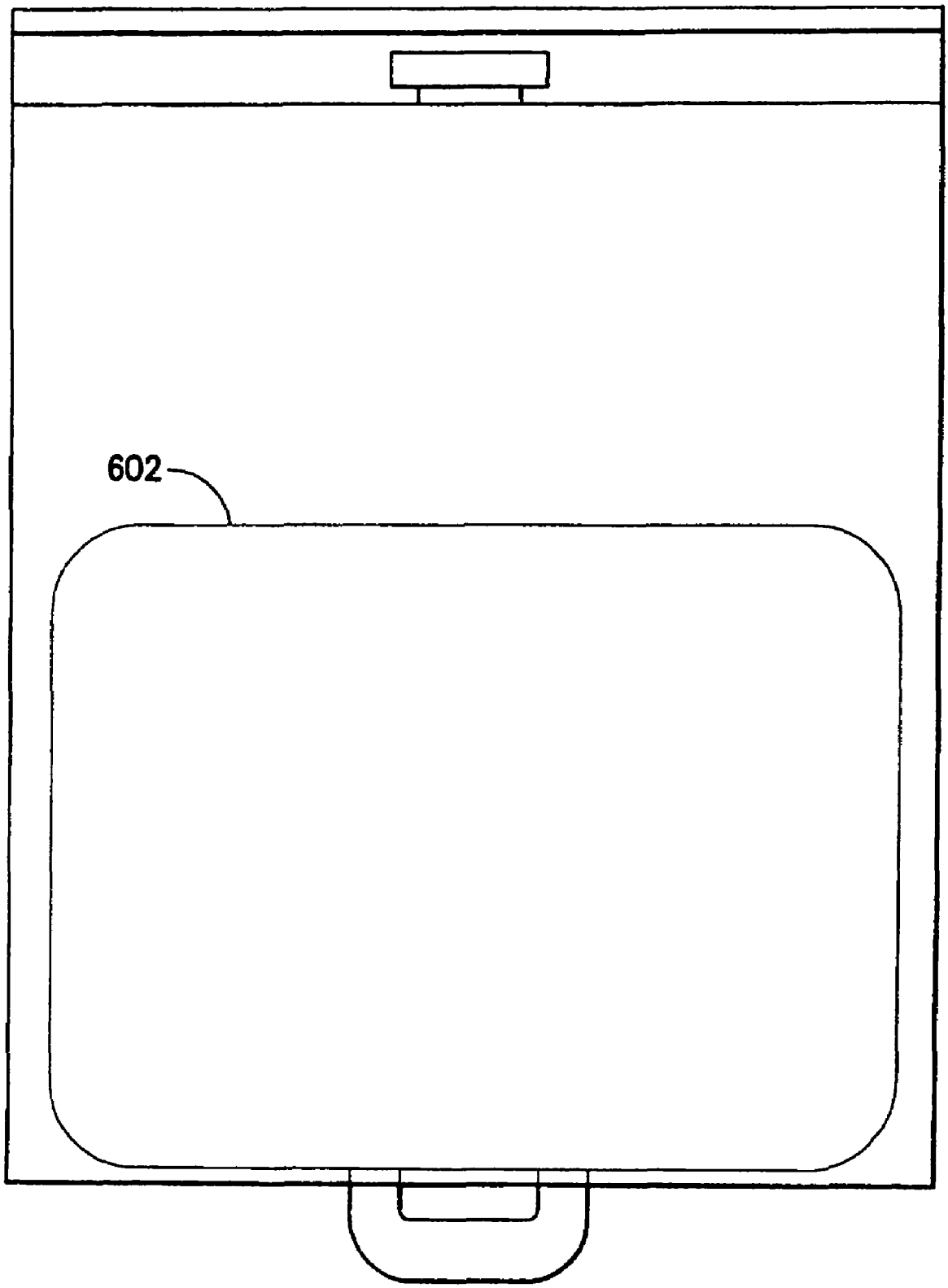
FIG. 6B is a plan view of a small suitcase surrounded by the intelligent luggage protection pouch of FIG. 1.
Figure 6C:
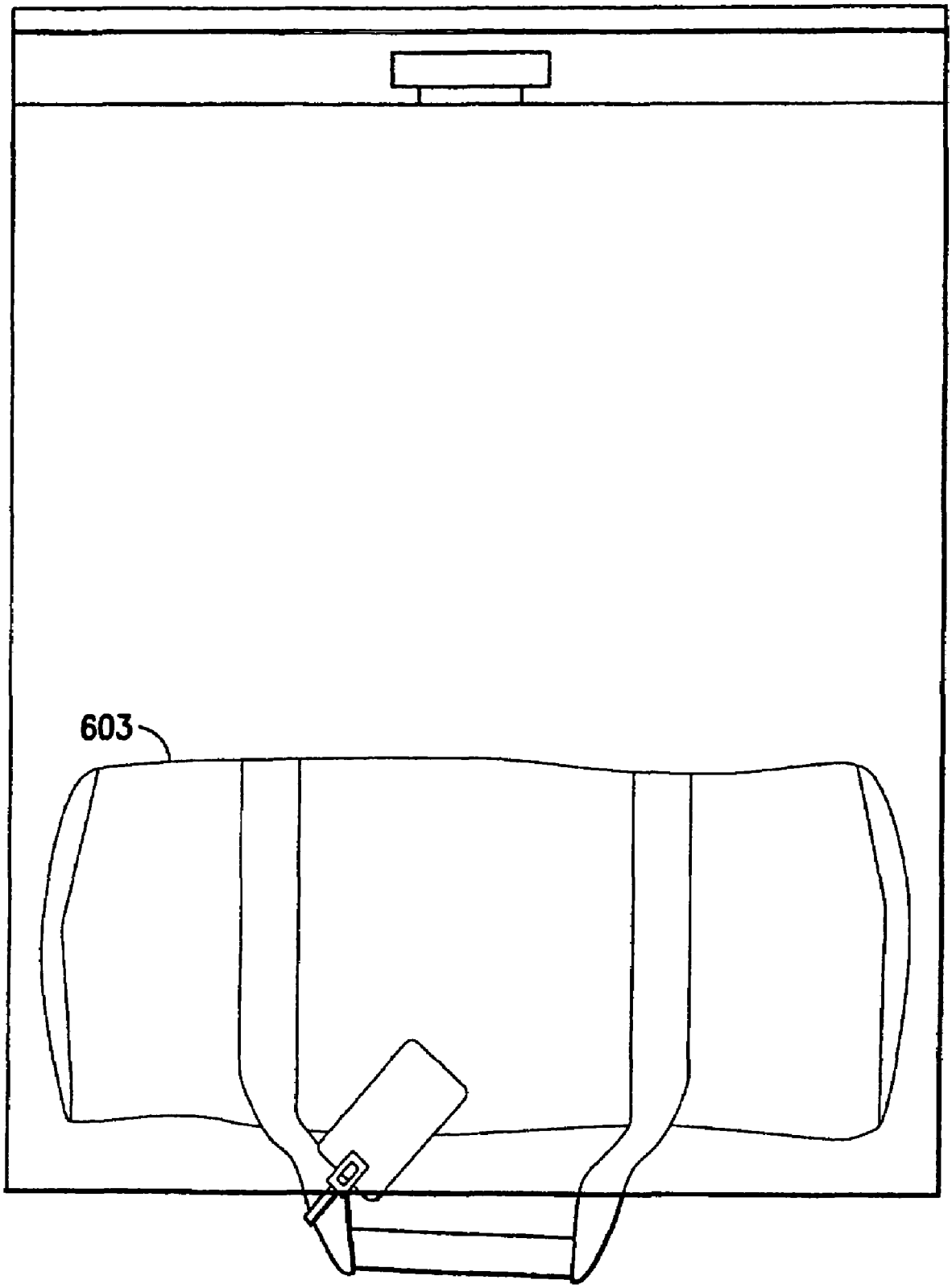
FIG. 6C is a plan view of a duffle bag surrounded by the intelligent luggage protection pouch of FIG. 1.
Figure 6D:
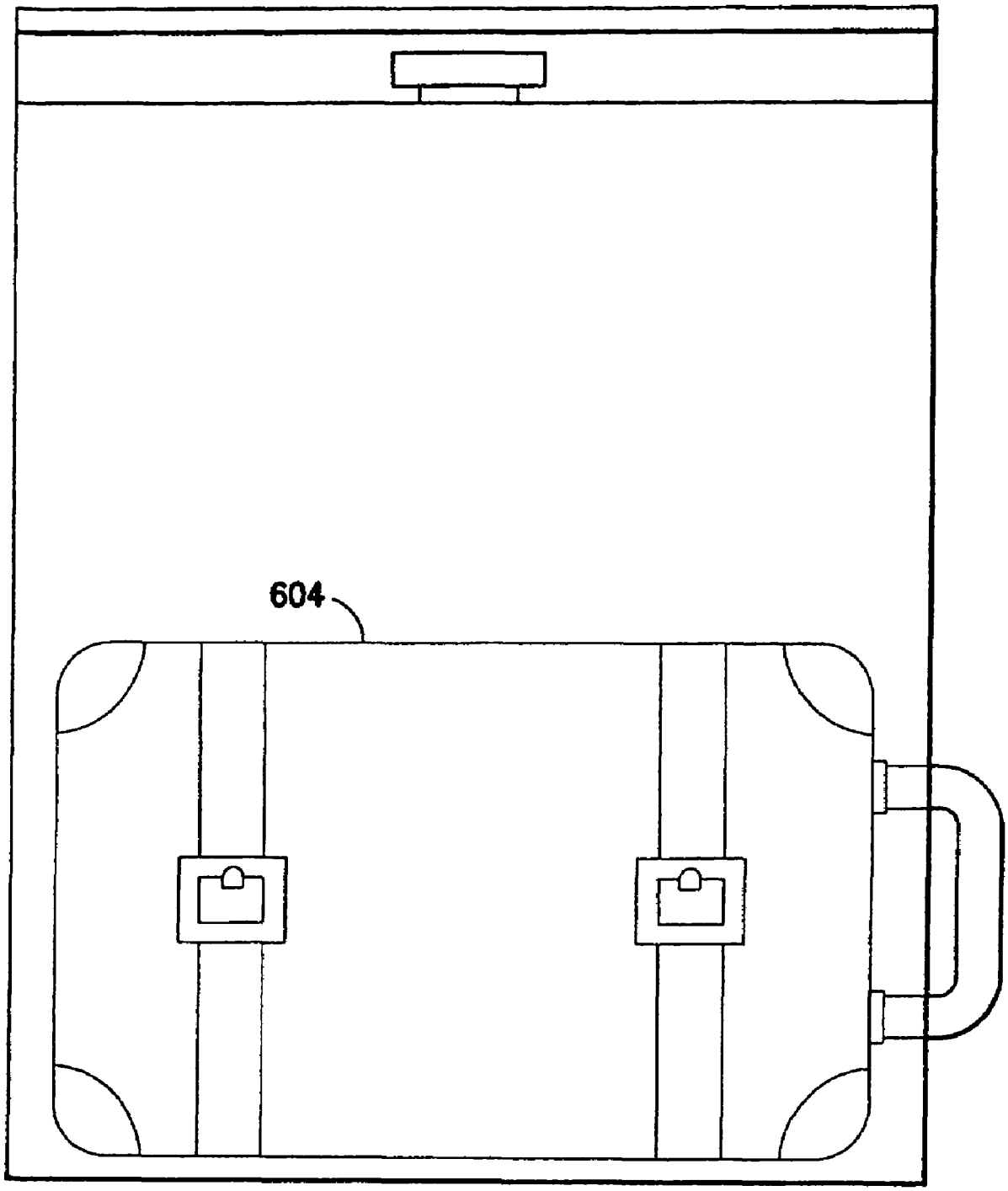
FIG. 6D is a plan view of a carry-on tote bag surrounded by the intelligent luggage protection pouch of FIG. 1.

FIG. 6A is a plan view of a large suitcase 601 surrounded by intelligent luggage protection pouch 1. FIG. 6B is a plan view of a small suitcase 602 surrounded by intelligent luggage protection pouch 1. FIG. 6C is a plan view of a duffle bag 603 surrounded by intelligent luggage protection pouch 1. FIG. 6D is a plan view of a carry-on tote bag 604 surrounded by intelligent luggage protection pouch 1.

While the invention has been disclosed in preferred forms, it will be apparent to those skilled in the art that many modifications, additions, and deletions may be made therein without departing from the spirit and scope of the invention as set forth in the following claims.

I claim:

1. An intelligent luggage protection pouch comprising:

a tear-resistant, flexible wall, defining a contained interior space;

a mouth disposed in the wall;

a reusable temporary seal for releasably closing the mouth;

a single-use, tamper-resistant seal for securely closing the mouth; and means for identification selected from the group consisting of: barcode, personal identification number, serial number, smart card, radio frequency identification card, electronic transmitter, ornamental design or shape, and any combination thereof.

2. The intelligent luggage protection pouch of claim 1, wherein the temporary seal consists essentially of a low-adhesive polymeric material.

3. The intelligent luggage protection pouch of claim 1, wherein the single-use, tamper-resistant seal consists essentially of a high-adhesive polymeric material.

4. The intelligent luggage protection pouch of claim 1, wherein the mouth is disposed along an edge of the wall, and wherein the temporary seal is disposed closer to the edge than the permanent seal.

5. The intelligent luggage protection pouch of claim 1, wherein the pouch is about 40 inches by about 50 inches.

6. The intelligent luggage protection pouch of claim 1, wherein the pouch has a burst strength of about 100 lbs.

7. An intelligent luggage protection pouch comprising:

a tear-resistant, flexible wall, defining a contained interior space, said wall having an aperture formed therein for receiving a luggage handle a mouth disposed in the wall;

a first single-use, tamper-resistant seal for securely closing the mouth;

a second single-use, tamper-resistant seal for securely closing the mouth; and means for identification selected from the group consisting of: barcode, personal identification number, serial number, smart card, radio frequency identification card, electronic transmitter, ornamental design or shape, and any combination thereof.

8. The intelligent luggage protection pouch of claim 7, wherein the tamper-resistant seals consist essentially of a high-adhesive polymeric material.

9. The intelligent luggage protection pouch of claim 7, wherein the wall consists essentially of a 3-ply co-extruded polyethylene film.

10. The intelligent luggage protection pouch of claim 7, wherein the pouch is about 40 inches by about 50 inches.

11. The intelligent luggage protection pouch of claim 7, wherein the pouch has a burst strength of about 100 lbs.

12. An intelligent luggage protection kit comprising:

a) an intelligent luggage protection pouch comprising:

a tear-resistant, flexible wall defining a contained interior space; said wall having an aperture formed therein for recieving a luggage handle;

a mouth disposed in the wall;

a reusable temporary seal for releasably closing the mouth;

a single-use, tamper-resistant seal for securely closing the mouth; and means for identification selected from the group consisting of: barcode, smart card, radio frequency identification card, electronic transmitter, and any combination thereof; and b) one or more items selected from the group consisting of: additional luggage protection pouches, writing implements, user manuals, RFID card tags, and advertisements.

13. An intelligent luggage protection kit comprising:

a) an intelligent luggage protection pouch comprising:

a tear-resistant, flexible wall defining a contained interior space, said wall having an aperture formed therein for receiving a luggage handle;

a mouth disposed in the wall;

a first single-use, tamper-resistant seal for securely closing the mouth;

a second single-use, tamper-resistant seal for securely closing the mouth; and means for identification selected from the group consisting of: barcode, personal identification number, serial number, smart card, radio frequency identification card, electronic transmitter, ornamental design or shape, and any combination thereof; and b) one or more items selected from the group consisting of: additional luggage protection pouches, writing implements, user manuals, RFID card tags, and advertisements.

14. A method of protecting luggage, which comprises the steps of:

providing an intelligent luggage protection pouch comprising:

a tear-resistant, flexible wall defining a contained interior space;

a mouth disposed in the wall;

a reusable temporary seal for releasably closing the mouth;

a single-use, tamper-resistant seal for securely closing the mouth;

means for identification selected from the group consisting of: barcode, personal identification number, serial number, smart card, radio frequency identification card, electronic transmitter, ornamental design or shape, and any combination thereof; and inserting a piece of luggage into the intelligent luggage protection pouch.

15. The method of claim 14, further comprising the steps of:

cutting open the intelligent luggage protection pouch between the reusable temporary seal and the tamper-resistant seal and removing the luggage for allowing inspection of the luggage; and reinserting the piece of luggage into the intelligent luggage protection pouch and resealing the intelligent luggage protection pouch by securely closing the mouth with the tamper-resistant seal after the inspection is complete.

16. A method of protecting luggage, which comprises the steps of:

providing an intelligent luggage protection pouch comprising:

a tear-resistant, flexible wall defining a contained interior space;

a mouth disposed in the wall;

a first single-use, tamper-resistant seal for securely closing the mouth;

a second single-use, tamper-resistant seal for securely closing the mouth;

means for identification selected from the group consisting of: barcode, personal identification number, serial number, smart card, radio frequency identification card, electronic transmitter, ornamental design or shape, and any combination thereof; and inserting a piece of luggage into the intelligent luggage protection pouch.

17. The method of claim 16, further comprising the steps of:

cutting open the intelligent luggage protection pouch between the first single-use, tamper-resistant seal and the second single-use, tamper-resistant seal and removing the luggage for allowing inspection of the luggage; and reinserting the piece of luggage into the intelligent luggage protection pouch and resealing the intelligent luggage protection pouch by securely closing the mouth with the tamper-resistant sea), after the inspection is complete.

18. The method of claim 16, further comprising the step of securely closing the mouth of the intelligent luggage protection pouch with at least one of the tamper-resistant seals.

* * * * *